US007797940B2

(12) United States Patent
Kaplan

(10) Patent No.: US 7,797,940 B2
(45) Date of Patent: Sep. 21, 2010

(54) METHOD AND SYSTEM FOR PRODUCING POWER FROM A SOURCE OF STEAM

(75) Inventor: Uri Kaplan, Moshav Galia (IL)

(73) Assignee: Ormat Technologies Inc., Reno, NV (US)

( * ) Notice: Subject to any disclaimer, the term of this patent is extended or adjusted under 35 U.S.C. 154(b) by 1177 days.

(21) Appl. No.: 11/347,309

(22) Filed: Feb. 6, 2006

(65) Prior Publication Data

US 2007/0095066 A1 May 3, 2007

Related U.S. Application Data

(63) Continuation-in-part of application No. 11/261,644, filed on Oct. 31, 2005.

(51) Int. Cl.
*F16D 31/02* (2006.01)

(52) U.S. Cl. ..... 60/641.2; 60/653; 60/671

(58) Field of Classification Search ..... 60/641.2, 60/651, 653, 671
See application file for complete search history.

(56) References Cited

U.S. PATENT DOCUMENTS 4,041,709 A * 8/1977 Rajakovics ..... 60/655
5,664,419 A * 9/1997 Kaplan ..... 60/641.2
5,809,782 A * 9/1998 Bronicki et al. ..... 60/641.2
6,009,711 A * 1/2000 Kreiger et al. ..... 60/641.2
6,880,344 B2 * 4/2005 Radcliff et al. ..... 60/772

OTHER PUBLICATIONS

U.S. Appl. No. 12/647,216, filed Dec. 24, 2009, Kaplan, et al.

* cited by examiner

*Primary Examiner*—Hoang M Nguyen
(74) *Attorney, Agent, or Firm*—Oblon, Spivak, McClelland, Maier & Neustadt, L.L.P.

(57) ABSTRACT

The present invention provides a power plant system for producing power using a source of steam, comprising: a vaporizer into which steam from a source of steam is supplied, for vaporizing organic working fluid flowing through the vaporizer; at least one turbine wherein one of the turbines is an organic vapor turbine to which the vaporized working fluid is supplied and which is suitable for generating electricity and producing expanded organic vapor; a recuperator for heating organic vapor condensate flowing towards the vaporizer the expanded organic vapor exhausted from the organic vapor turbine; and two or more stages of preheating means for additionally heating organic working fluid exiting the recuperator and flowing towards the vaporizer, wherein fluid extracted from one of the turbines is delivered to one of the stages of preheating means.

10 Claims, 19 Drawing Sheets

BINARY FLUID - E.G. PENTANE, ISOPENTANE, ETC.

BINARY FLUID - E.G. PENTANE, ISOPENTANE, ETC.

– – – – - OPTIONAL

BINARY FLUID - E.G. PENTANE, ISOPENTANE, ETC.

BINARY FLUID - E.G. PENTANE, ISOPENTANE, ETC.

– – – – - OPTIONAL

METHOD AND SYSTEM FOR PRODUCING POWER FROM A SOURCE OF STEAM

FIELD OF THE INVENTION

The present invention relates to the field of energy production. More particularly, the invention relates to a method and system for producing power from geothermal steam, particularly geothermal fluid having a relatively low liquid content.

BACKGROUND OF THE INVENTION

There have been many attempts in the prior art to increase the utilization of the heat retained in a source of steam, in order to produce power. Two-phase geothermal steam has been shown to be a convenient and readily available source of power producing steam in many areas of the world.

In one method, water and steam are separated at a wellhead of geothermal fluid, and the two fluids are utilized in separate power plants. However, the thermodynamic efficiency of a power plant operating on geothermal water may be too low to warrant the capital cost of the equipment.

U.S. Pat. No. 5,088,567 discloses a method for utilizing separated geothermal water and geothermal steam in a single power plant. The geothermal water preheats the working fluid before the latter is introduced to a vaporizer, from the condenser cooled temperature to the temperature just below that of the vaporizer. The geothermal steam heats the working fluid within the vaporizer at conditions of constant temperature and pressure. The vaporized working fluid is expand in a heat engine and the heat-depleted working fluid is condensed to produce condensate which is returned to the vaporizer.

U.S. Pat. No. 5,660,042 discloses a similar method for using two-phase liquid in a single Rankine cycle power plant, and vaporized working fluid is applied in parallel to a pair of turbine, one of which may be a steam turbine.

U.S. Pat. No. 5,664,419 discloses the use of a vaporizer, preheater, and recuperator. The vaporizer produces vaporized organic fluid to be expanded in the tubing and cooled geothermal steam. The preheater transfers sensible heat to the organic fluid from separated geothermal brine and from steam condensate from the vaporizer. The recuperator, which receives organic vapor exhausted from the turbine, permits additional heat to be used by the organic working fluid by heating condensed organic liquid pumped to the vaporizer through the recuperator and preheater.

The use of a recuperator also allows heat to be more efficiently transferred from the geothermal steam to the organic working fluid. The evident heat transfer from the geothermal steam to the organic working fluid is reflected by the similarity of the heat transfer rate of the working fluid with respect to that of geothermal steam. As shown in FIG. 1, which is a temperature T/heat Q diagram of both the working fluid and the geothermal steam, the heat transfer rate of the organic working fluid and of the geothermal steam is substantially similar. Curve 5 represents the heat transfer rate of the geothermal fluid as it enters the vaporizer and exits the preheater at point A, while curve 6 represents the heat transfer rate of the organic working fluid. The inclined portion of curve 6 from the condenser temperature and rising to point E, which is the boiling temperature of the working fluid, represents the sensible temperature rise of the working fluid as it flows through the preheater and vaporizer. Q2 represents the amount of heat input to the working fluid. The break point, or the discontinuity, of working fluid curve 6 is shown to be vertically below that of geothermal fluid curve 5, and therefore heat is efficiently transferred to the working fluid. As the gap between corresponding points of curves 5 and 6 increases, more heat is dissipated and less heat is transferred to the working fluid from the geothermal fluid. For purposes of comparison, curve 1 represents the heat transfer rate of working fluid of a power plant provided without a recuperator as it rises from the condenser temperature to point D flowing a heat input of Q1. The use of the recuperator therefore increases the heat input by an amount of Q2-Q1.

At times, the liquid content of the geothermal fluid is not significantly high, and geothermal-based power plants are forced to use a portion of the high-temperature and high-pressure geothermal steam to preheat the organic working fluid, resulting in ineffective heat utilization.

There is therefore a need to provide a geothermal-based power plant system for producing power with a relatively efficient rate of heat transfer from geothermal fluid having a relatively low liquid content to organic working fluid.

It is an object of the present invention to provide a geothermal-based power plait system for producing power with a relatively efficient rate of heat transfer from geothermal fluid having a relatively low liquid content to organic working fluid.

It is an additional object of the present invention to provide a method for achieving a similar heat transfer rate of the working fluid as that of geothermal fluid when the power plant system utilised geothermal fluid has a relatively low liquid content.

Other objects and advantages of the invention will become apparent as the description proceeds.

SUMMARY OF THE INVENTION

The present invention provides a power plant system for producing power using a source of steam, comprising:

a) a vaporizer into which steam from a source of steam is supplied, for vaporizing organic working fluid flowing through said vaporizer;

b) at least one turbine wherein one of said turbines is an organic vapor turbine to which said vaporized working fluid is supplied and which is suitable for generating electricity and producing expanded organic vapor;

c) a recuperator for heating organic vapor condensate flowing towards said vaporizer said expanded organic vapor exhausted from said organic vapor turbine, and d) two or more stages of preheating means for additionally heating organic working fluid exiting said recuperator and flowing towards said vaporizer, wherein fluid extracted from one of said turbines is delivered to one of said stages of preheating means.

The present invention is also directed to a method for reducing the difference between heat efflux from power producing steam and heat influx into the wowing fluid, comprising the steps of:

a) supplying steam from a source of steam to a vaporizer, for vaporizing organic working fluid flowing therethrough;

b) providing at least one turbine wherein one of said turbines is an organic vapor turbine and delivering said vaporized working fluid to an organic fluid turbine to generate electricity and produce expanded organic vapor;

c) heating organic vapor condensate flowing towards said vaporizer within a recuperator by means of said expanded organic vapor exhausted from said organic vapor turbine; and d) providing two or sore stages of preheating means for additionally heating organic working fluid exiting said recuperator and supplying fluid extracted from a turbine to a stage of preheating means for additional heating organic working fluid exiting said recuperator and flowing towards said vaporizer.

DETAILED DESCRIPTION OF PREFERRED EMBODIMENTS

The present invention is related to a method and system for producing power with improved heat utilization from geothermal fluid having a relatively low liquid content. While the heat transfer rate of organic working fluid with respect to geothermal fluid of prior art geothermal-based power plants employing geothermal fluid having a relatively high liquid content to an organic working fluid is substantially similar, the heat transfer rate of organic working fluid with respect to geothermal fluid is significantly different when the geothermal fluid has a relatively low liquid content.

Figure 1:
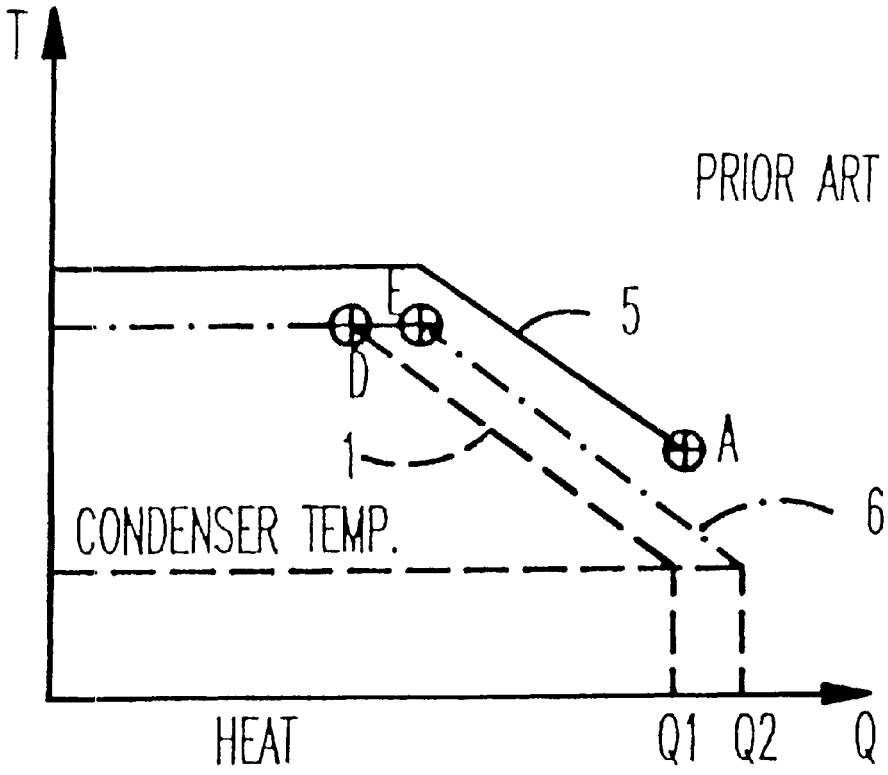
FIG. 1 is a temperature/heat diagram of a prior art geothermal-based poster plant system provided with a recuperator.
Figure 2:
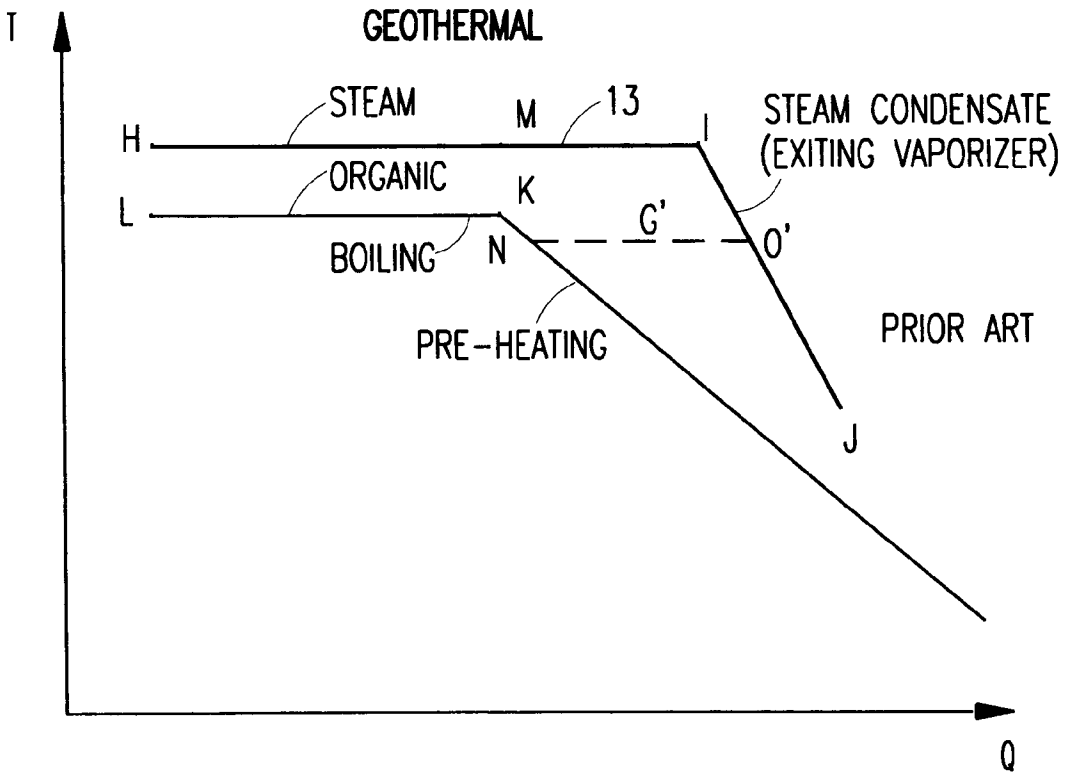
FIG. 2 is a temperature/heat diagram of a prior art power plant system powered by geothermal steam having a relatively low liquid content.

FIG. 2 illustrates a temperature T/heat Q diagram of both the working fluid and the geothermal steam for a prior art geothermal-based power plant employing a geothermal fluid which has a relatively low liquid content, necessitating relatively high-temperature and high-pressure geothermal steam to be delivered to a preheater in order to heat the organic working fluid before the latter is delivered to the vaporizer. Curve 13 indicated by a solid line represents the heat transfer rate of the geothermal steam as it undergoes constant-temperature heat transfer to the organic working fluid within the vaporizer front point H to point I and varying-temperature heat transfer to the organic working fluid within the preheater from point I to point J, while cure 14 indicated by a dashed line represents the heat transfer rate of the organic working fluid. The temperature of the organic working fluid increases within the preheater to point K, and the heat input to the working fluid increases within the vaporizer from point K to point L. Between points H and M of curve 13, the heat transfer rates of the geothermal steam and organic working fluid are equal. However, from point M to point I of curve 18, the heat transfer rates of the geothermal steam and organic working fluid within the preheater differ. As the gap, or the difference between heat efflux from the geothermal steam and heat influx absorbed by the working fluid, between corresponding points of curves 18 and 14 increases, more heat is dissipated and less heat is transferred to the working fluid from the geothermal fluid. A comparison of the heat transfer rates of, or an analysis of the gap between, the curves of the geothermal steam and organic working fluid is therefore beneficial in determining the efficiency of heat utilization.

Figure 3:
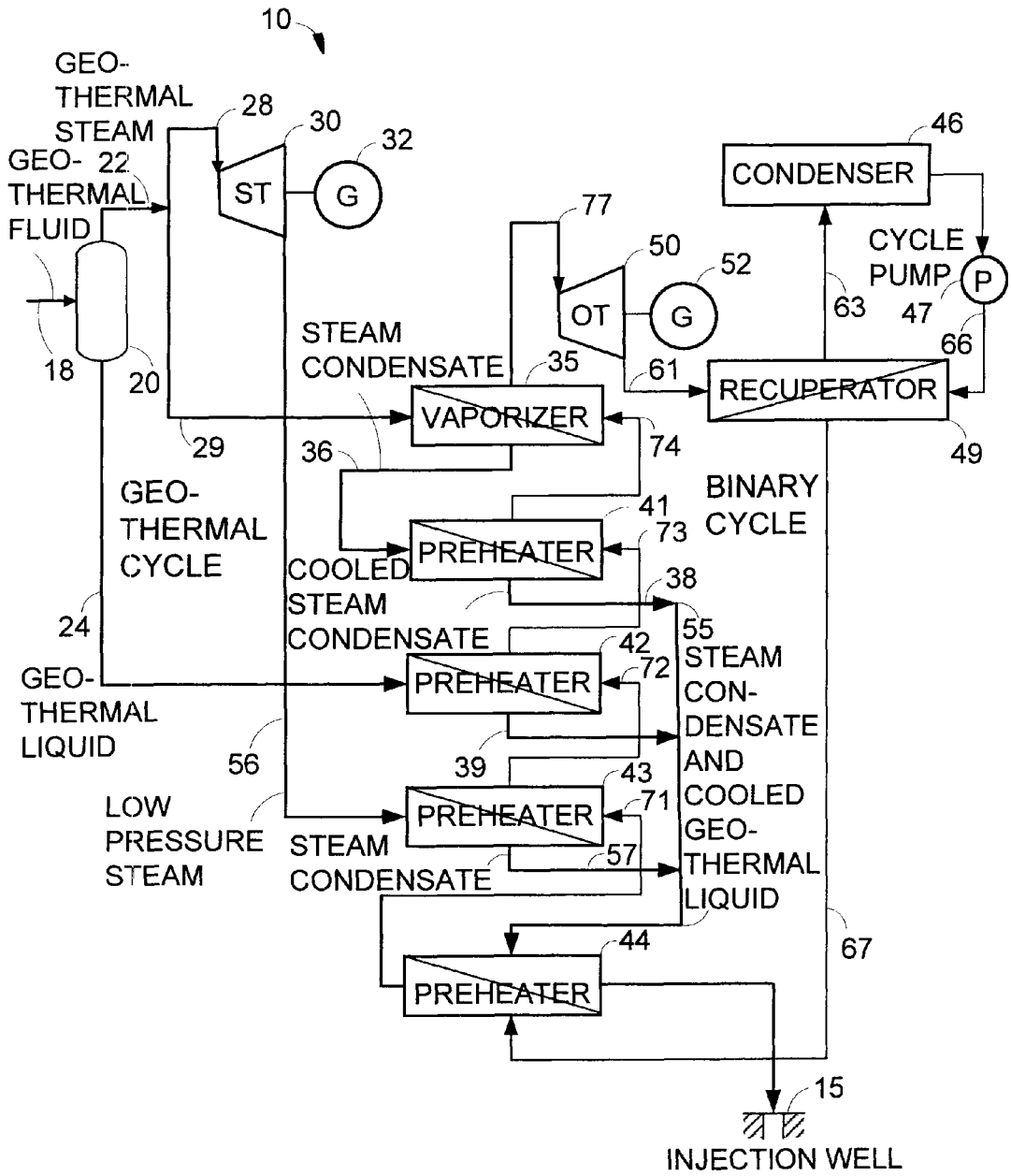
FIG. 3 is a block diagram of a geothermal-based power plant system provided with steam and organic turbines, according to one embodiment of the present invention.

FIG. 3 illustrates a power plant that produces power by means of a steam turbine (ST), which can be single or multi-staged and an organic fluid turbine (OT) operating according to an organic Rankine cycle wherein the energy source is a geothermal fluid which has a relatively low liquid content. The power plant system generally designated by reference numeral 10 is embodied by an open geothermal cycle represented by thick fluid lines wherein power producing geothermal fluid is delivered by production well 12 and rejected into injection well 15, and a closed binary cycle represented by thin fluid limes wherein binary working fluid exacts heat from the geothermal fluid to produce power in the OT.

Power plant system 10 comprises separator 20, steam turbine 80, generator 82 coupled to ST 80, vaporizer 35, cascading preheaters 41-44, condenser 46, pump 47, recuperator 49, organic fluid turbine 50, and generator 52 coupled to OT 50.

Geothermal fluid having a relatively low liquid content is delivered in line 18 to separator 20 and is separated thereby into geothermal steam flowing in line 22 and geothermal liquid flowing in line 24. The geothermal steam branches into lines 28 and 29, and consequently is advantageously used to both produce power in ST 30 and to vaporize binary cycle working fluid, e.g. preferably pentane and isopentane, (hereinafter referred to as "working fluid") so that the working fluid will produce power in OT 50. Geothermal steam of line 29 vaporizes preheated working fluid. The resulting geothermal steam condensate is delivered via line 36 to fourth stage preheater 41, and after its heat is transferred to the working fluid by means of preheater 41, the discharged cooled geothermal steam condensate flow, via line 88 to common conduit 55. Geothermal liquid, on the other hand, flowing in line 24 is delivered to third-stage preheater 42 and is discharged therefrom via line 39 to common conduit 55. Low pressure steam from the exhaust of ST 30 is delivered via line 56 to second-stage preheater 43 and is discharged therefrom as steam condensate, which is delivered via line 57 to common conduit 55. The geothermal fluid discharged from preheaters 41-43 is combined in common conduit 55 and is delivered to first-stage preheater 44. The geothermal fluid discharged from preheater 44 is then rejected into injection well 15.

OT 50 exhausts heat depleted organic vapor, after work has been performed, via line 61 to recuperator 49. The organic vapor exits recuperator 49 via line 63 and is delivered to condenser 46, which condenses the vapor by means of a cooling fluid (not shown). Condensed working fluid is circulated by pump 47 through line 66 to recuperator 49, which is adapted to transfer heat from the heat depleted organic vapor to the condensed working fluid, and then through line 67 to first-stage preheater 44, from which the condensed working fluid is discharged via line 71. Additional heat is transferred to the working fluid by means of second-stage preheater 43, third-stage preheater 42, and fourth stage preheater 41 while the working fluid is discharged from these preheaters via lines 72-74, respectively. Preheated working fluid exiting fourth stage preheater 41 is supplied via line 74 to vaporizer 35. Vaporized working fluid produced in vaporizer 85 is delivered to OT 60 via line 77.

Figure 3A:
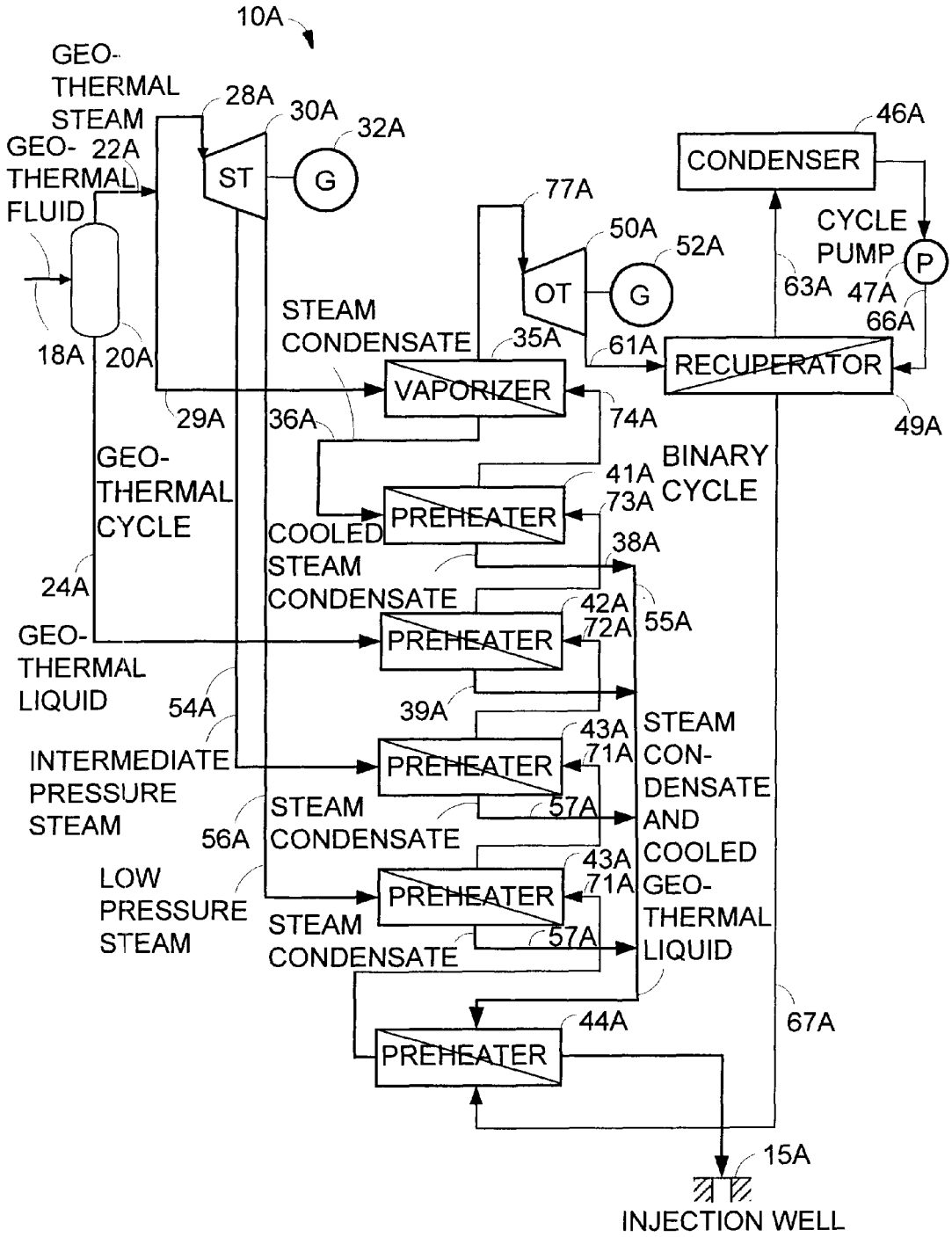
FIG. 3A is a block diagram of a geothermal-based power plant system provided with steam and organic turbines, similar to the embodiment of the present invention shown in FIG. 3.

FIG. 3A shows a similar embodiment of the invention described with reference to FIG. 3 but shows an example of the use of a multi-stage, here shown as a two stage steam turbine. As can be seen from FIG. 3A, intermediate pressure steam is extracted from an intermediate stage of ST 30A and is delivered via line 54A to preheater 43'A where it transfers heat contained therein to organic working fluid and is discharged therefrom as steam condensate, which is delivered via line 57'A to common conduit 55A. Apart from this, the rest of the power plant as well as its operation is substantially identical to geothermal power plant system 10, shown in FIG. 3, and therefore or brevity need not be described.

Figure 4:
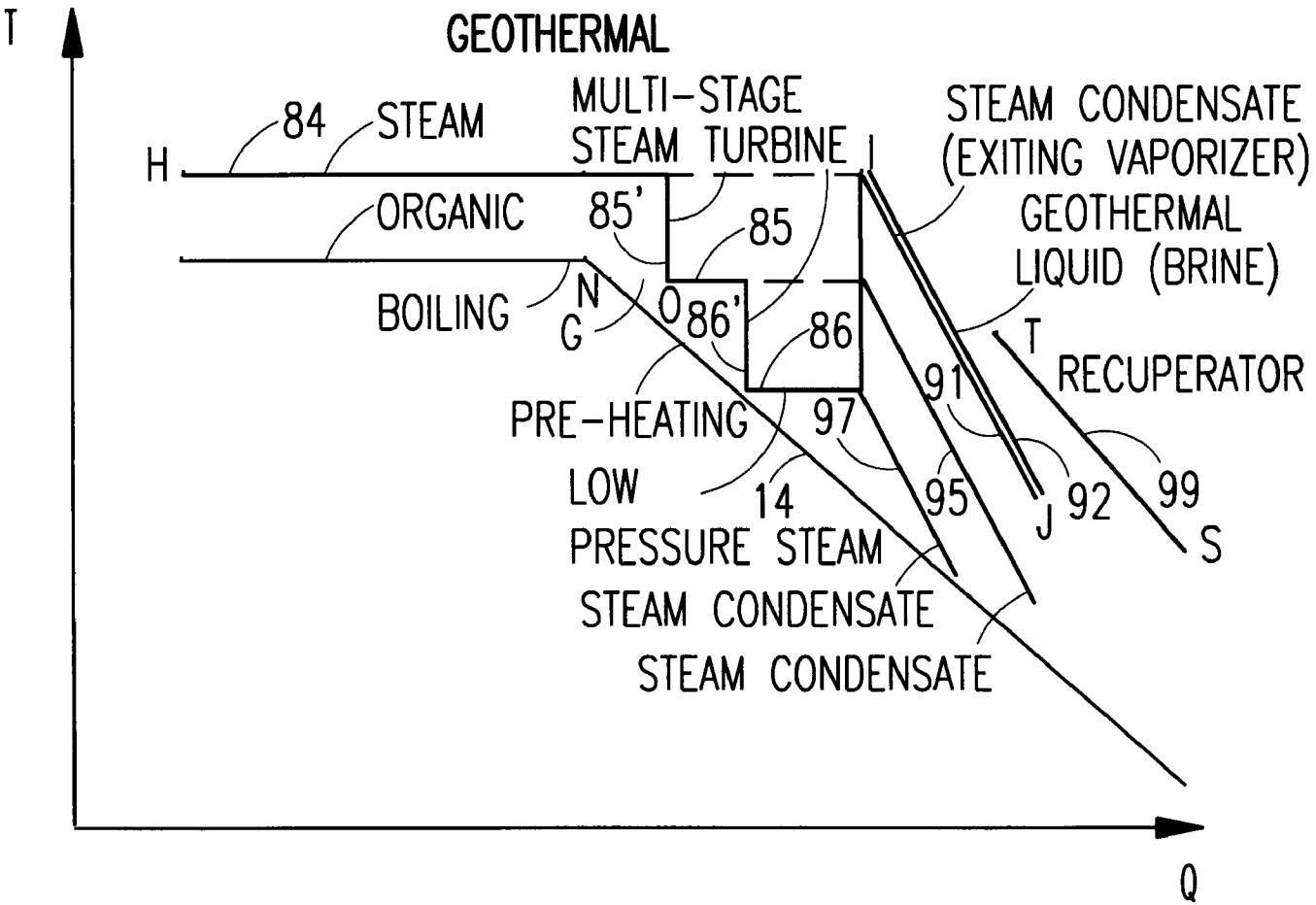
FIG. 4 is a temperature/heat diagram for the power plant system of FIG. 3.

FIG. 4 illustrates a temperature/heat diagram for power plant system 10 of FIG. 3. This temperature/heat diagram is also applicable for the power plant system 10A of FIG. 3A. A portion of a plurality of curves, each of which corresponds to a different heat transfer process of power plant system 10, are shown in superimposed relation, to illustrate the reduced gap between corresponding points of the working fluid curve and one of the geothermal fluid curves with respect to the resulting gap of a prior first system shown in FIG. 2. Curve 14 represents the heat transfer rate of the working fluid, due to the heat influx by means of the preheaters and the vaporizer. Curve 99 represents the heat influx to the working fluid from point S to point T as it passes through the recuperator, after being delivered thereto from the condenser. Curve 84 represents the constant-temperature heat transfer rate of geothermal steam from point H to point I which is realized by means of the heat transfer process carried out within the vaporizer. Curves 85' and 86' represent the expansion of geothermal steam in the steam turbine, shown here illustratively as an example as a two-stage expansion of geothermal steam within the steam turbine, and curves 85 and 86 represent the corresponding low pressure steam that exits the steam at each of the two stars, respectively, and which is delivered to the second-stage preheat. Curve 91 represents the steam condensate which exits the vaporizer and which is delivered to the fourth-stage preheater. Curve 92 represents the geothermal liquid or brine which is delivered to the third-stage preheater. Curve 95 represents the steam condensate which exits the second-stage preheater and is mixed in the common conduit with the discharge from the third and further-stage preheaters, to be delivered to the first-stage preheater.

As can be clearly seen, gap G between point N of the working fluid curve 14 and corresponding point O of the low pressure steam curve 85 exiting one stage of the steam turbine is dramatically less, approximately 10%, than the gap G' of the prior art system shown in FIG. 2 between the same point N of the working fluid curve 14 and corresponding point O'. A gap indicative of the difference between heat efflux from the geothermal fluid and heat influx into the working fluid is graphically determined by constructing a horizontal line from a desired point of a curve.

Figure 5:
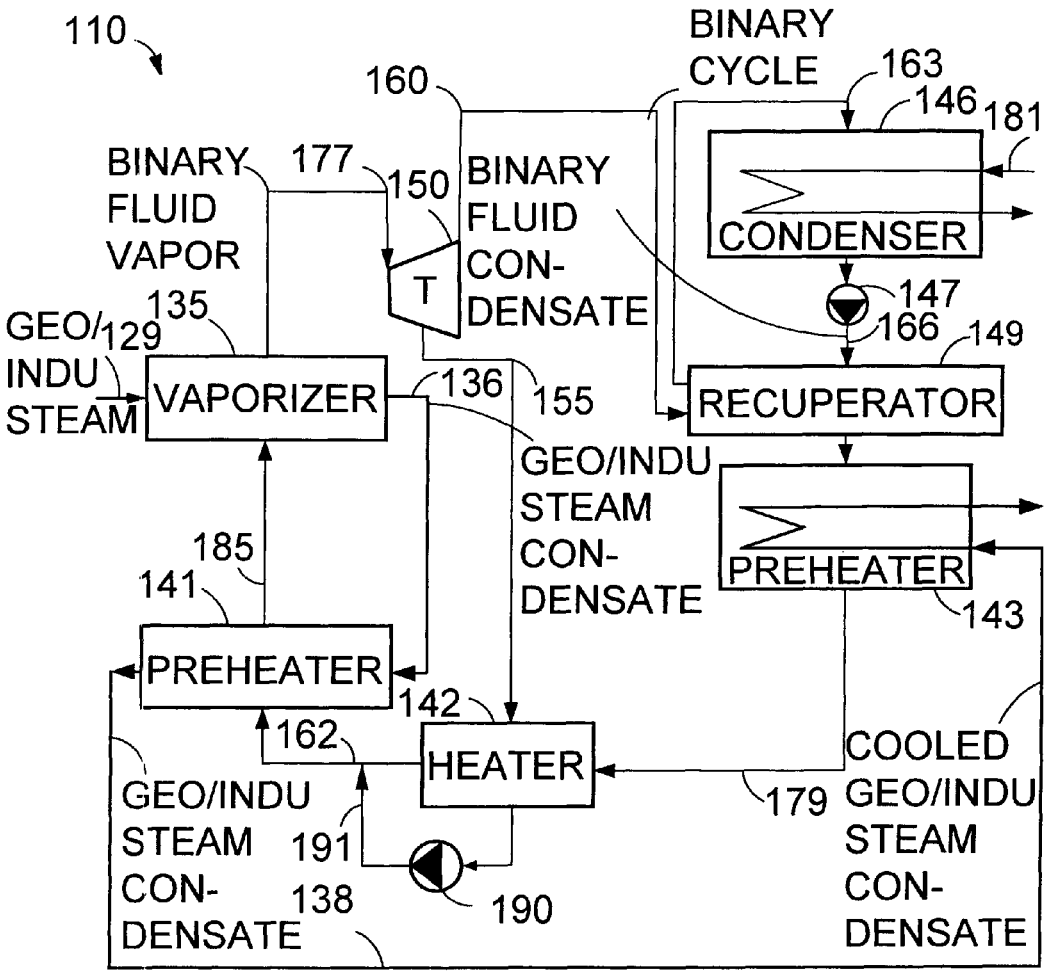
FIG. 5 is a block diagram of a geothermal-based power plant system provided with one organic turbine, according to another embodiment of the invention.

FIG. 5 illustrates another embodiment of the invention wherein power plant system 110 produces power by means of organic fluid turbine 150. The power plant system is embodied by an open geothermal cycle represented by thick fluid lines wherein power producing geothermal fluid having a low liquid content is delivered by a production well and rejected into an injection well and a closed binary cycle represented by thin fluid lines wherein binary working fluid extracts heat from the geothermal fluid to produce power in turbine 150.

Power plant system 110 comprises organic fluid turbine 150, a generator (not shown) coupled to turbine 150, vaporizer 185, a three stage process or preheating the working fluid that includes heater 142 and preheaters 141 and 143, condenser 146, pump 147, and recuperator 149.

Geothermal steam flowing in line 129 is delivered to vaporizer 185 and vaporizes preheated working fluid. The resulting geothermal steam condensate is delivered via line 136 to third-stage preheater 141, and after its heat is transferred to the working fluid by means of preheater 141, the discharged geothermal steam condensate flows via line 138 to first-stage preheater 143, from which it is rejected into the injection well.

Vaporized working fluid is delivered to OT 150 via line 177. The exhaust from turbine 150 is discharged through 160. The turbine exhaust flowing through line 160 is delivered to recuperator 149, from which it exit via line 163, is delivered to condenser 146. Condensed working fluid, which is condensed by means of cooling fluid 181, is circulated by pump 147 via line 166 to recuperator 149 adapted to transfer heat from the organic vapor exhausted from OT 156 to the condensed working fluid, and then through line 167 to first-stage preheater 148. The working fluid is heated in first-stage preheater 148 by the geothermal steam condensate flowing through line 188, and is delivered via line 179 to second-stage heater 142 and then heated thereby by vapor extracted via the turbine bleed bled through line 155, and thereafter is delivered via line 162 to third-stage preheater 141 and then heated thereby by the geothermal steam condensate exited from vaporizer 135. The preheated working fluid exiting third-stage preheater 141 is then delivered to vaporizer 185 via line 185. Pump 190 assists in circulating the condensed turbine bleed exiting heater 142 via lines 191 and 162.

Under some circumstances, first-stage preheater 148 might not be used so that preheater 148 can be considered optional.

Figure 5A:
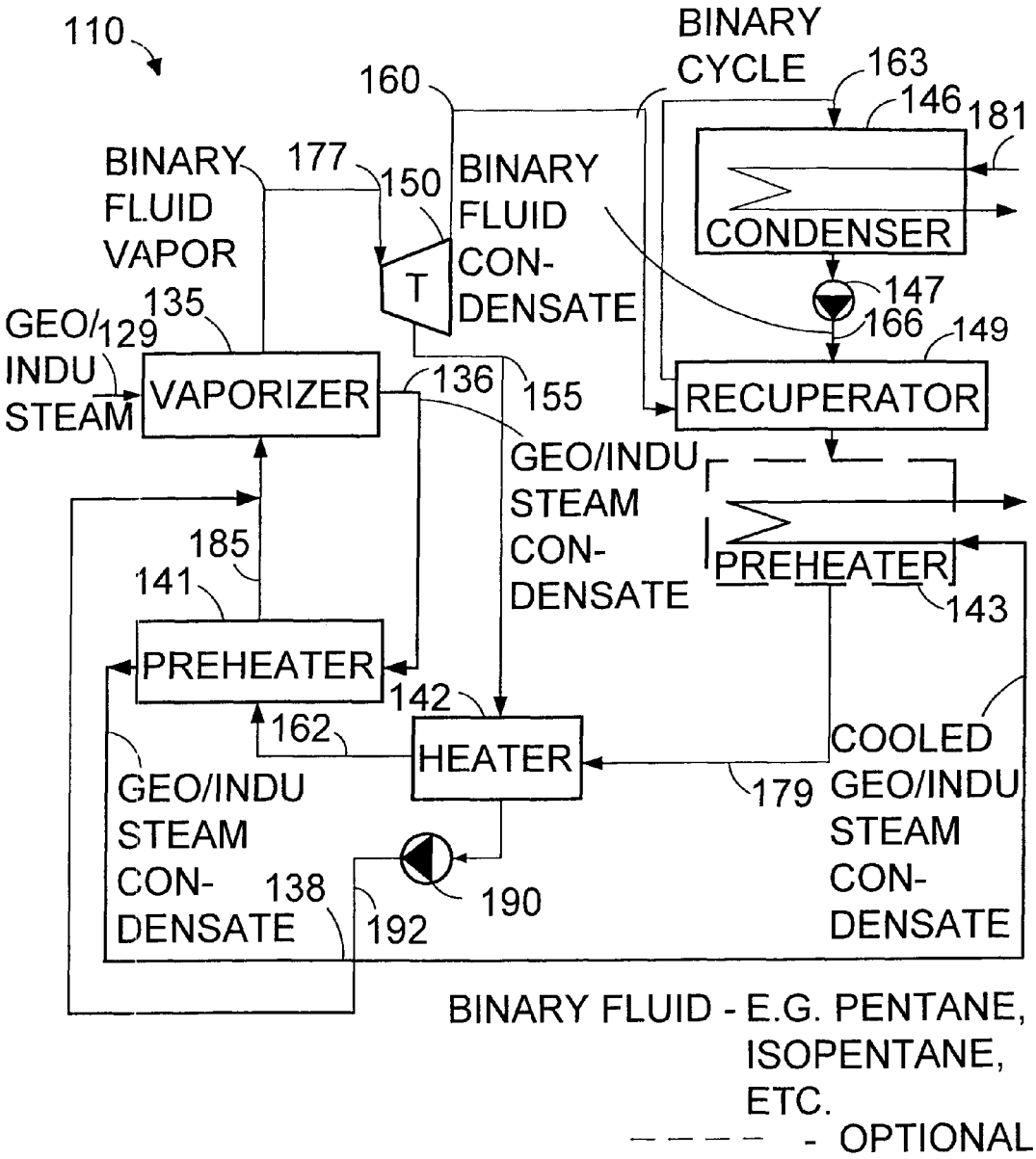
FIG. 5A is a block diagram of a geothermal-based power plant system provided with one organic turbine, according to another optional arrangement of the embodiment of the invention shown in and described with reference to FIG. 5.
Figure 5B:
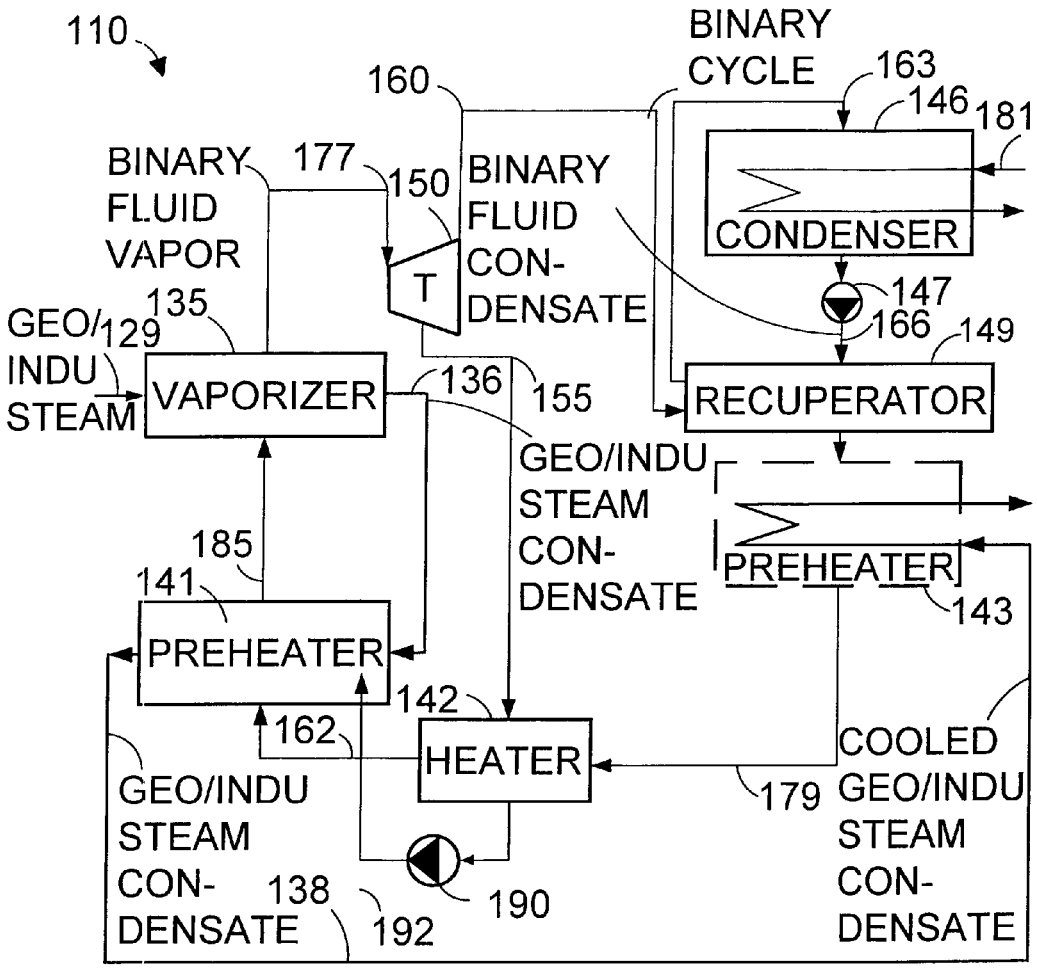
FIG. 5B is a block diagram of a geothermal-based power plant system provided with one organic turbine, according to another optional arrangement of the embodiment of the invention shown in and described with reference to FIG. 5.
Figure 5C:
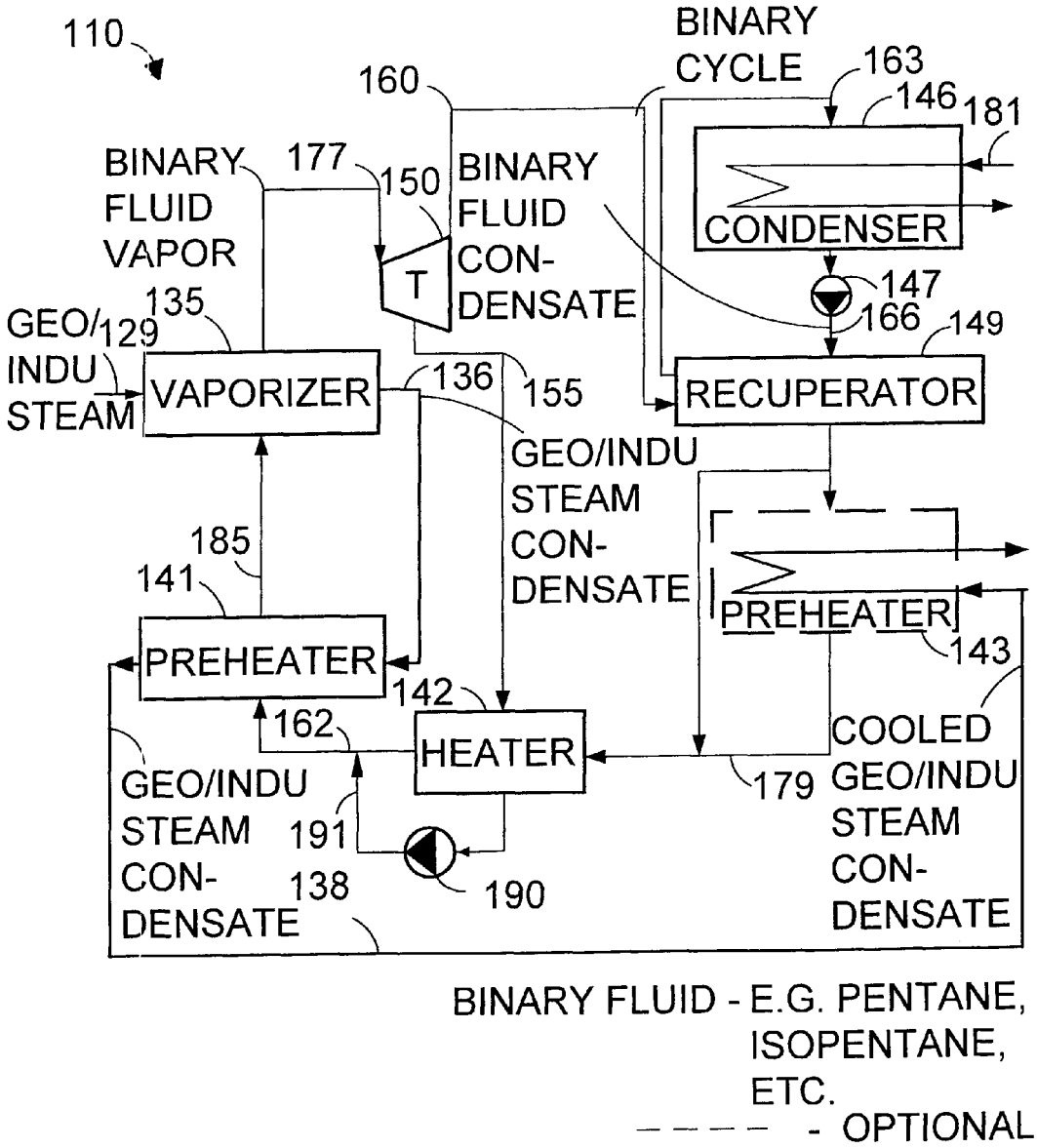
FIG. 5C is a block diagram of a geothermal-based power plant system provided with one organic turbine, according to another optional arrangement of the embodiment of the invention shown in and described with reference to FIG. 5.

Furthermore, the heated working fluid output of pump 190 exiting heater 142 can be supplied to different locations in the working fluid cycle of the binary cycle power plant (see FIGS. 5, 5A and 5B) in different optional configurations. In the option shown in FIG. 5, the output of the pump is supplied to the output of heater 142. In the option shown in FIG. 5A, the output of pump 190 is supplied to the output of third-stage preheater 141 and supplied to the vaporizer. In the option shown in FIG. 5B, the output of pump 190 is supplied to a suitable location in the third-stage preheater 141. In addition, in a further option, portion of the working liquid exiting recuperator 149 can be supplied to first-stage preheater 143 while a further portion can be supplied to the working fluid exiting the first-stage preheater 148 and that is supplied to heater 142 (see FIG. 5C).

Figure 6:
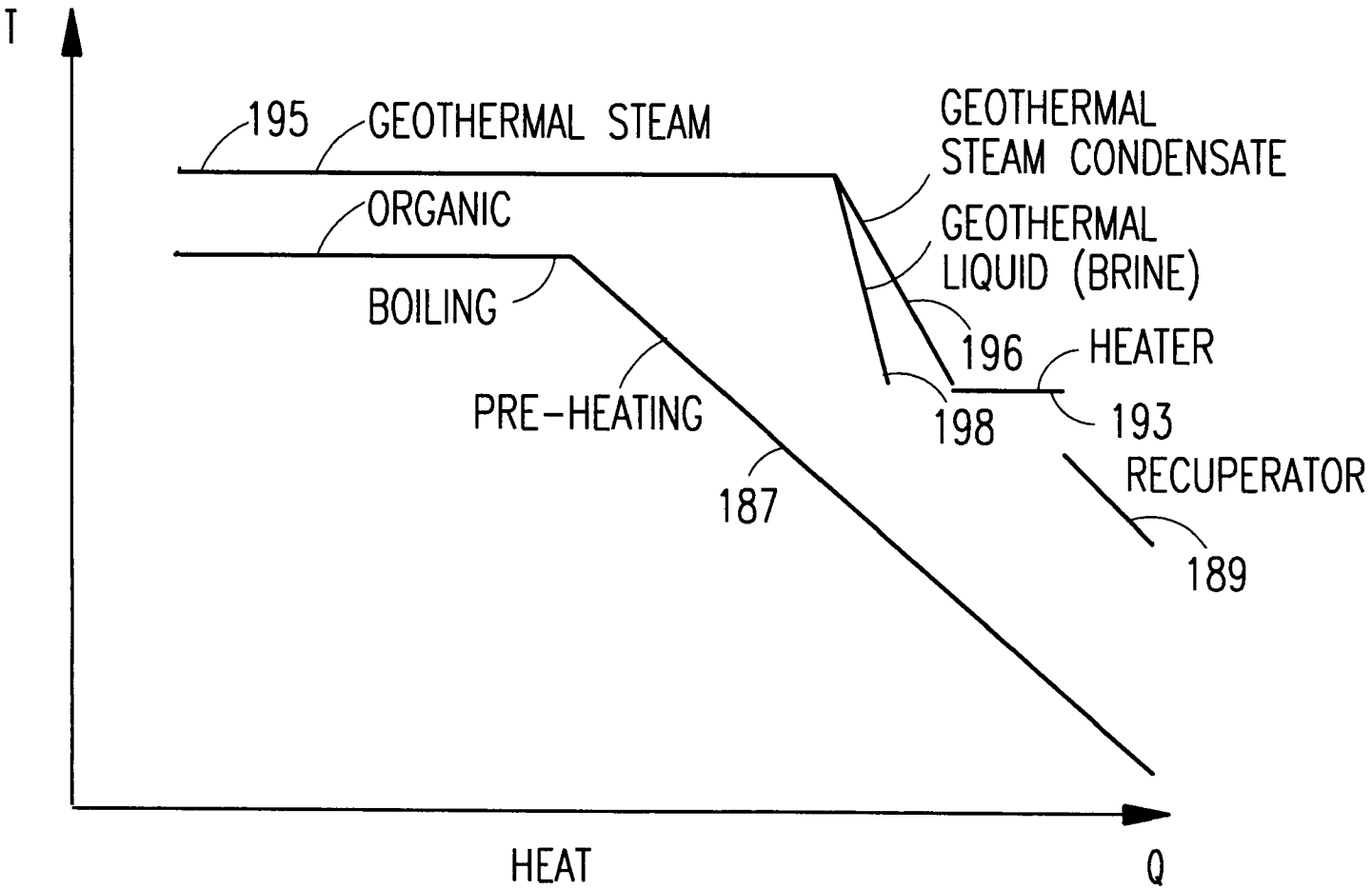
FIG. 6 is a temperature/heat diagram for the power plant system of FIG. 5
Figure 7:
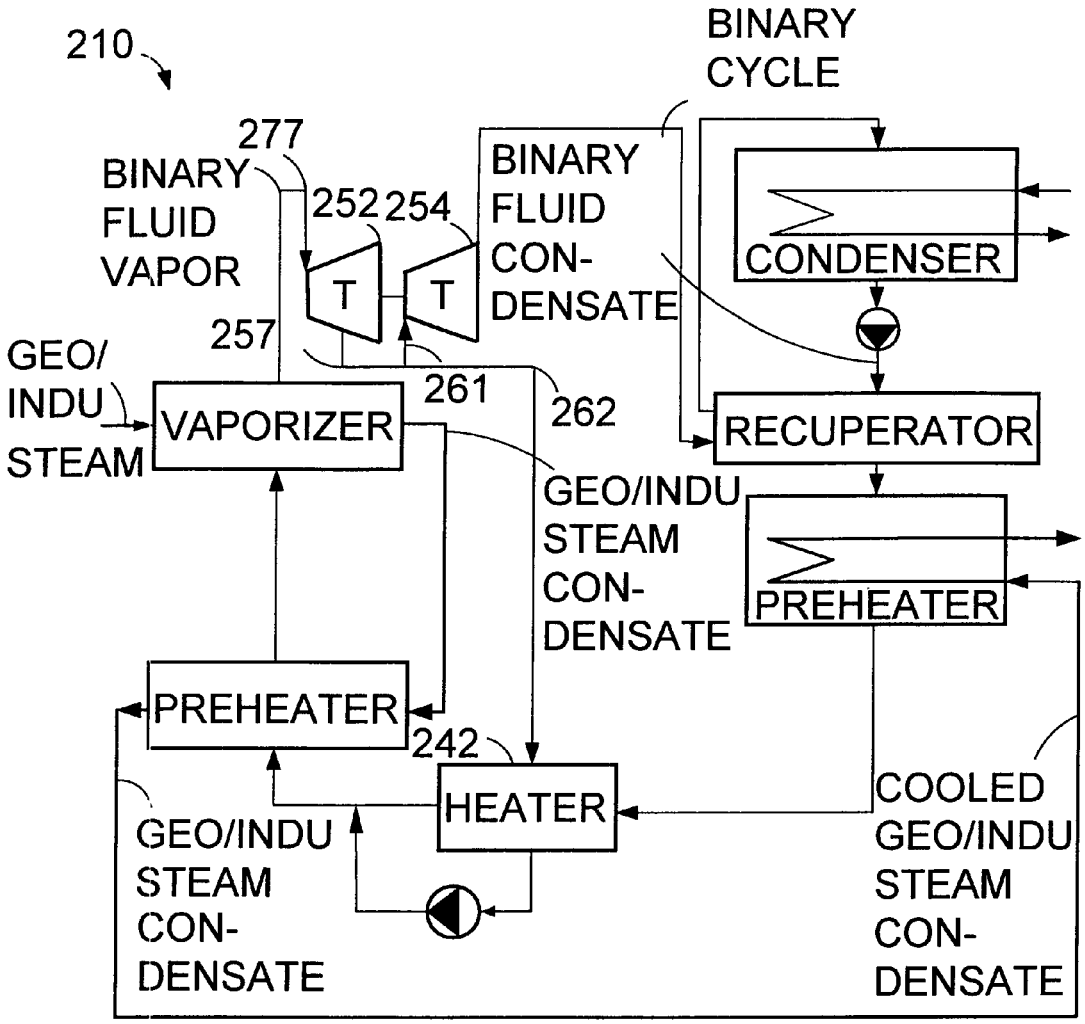
FIG. 7 is a block diagram of a geothermal-based power plant system provided with two organic turbines according to another embodiment of the invention.

FIG. 6 illustrates a temperature/heat diagram for power plant system 110 of FIG. 5. A plurality of curve portions, each of which corresponds to a different heal transfer process of power plant system 110, are shown in superimposed relation. Curve 187 represents the heat transfer rate of the working fluid, due to the heat influx by means of the preheaters and the vaporizer. Curve 189 represents the heat influx from working fluid expanded vapor to the working fluid condensate as it passes through the recuperator, after being delivered thereto from the condenser. Curve 198 represents the constant-temperature heat influx from working fluid vapor (bled via line 155 from vapor turbine 150) to the working fluid as it passes through the heater. Curve 195 represents the constant-temperature heat transfer rate of geothermal steam by means of the heat transfer process carried out within the vaporizer. Curve 196 represents the steam condensate which sits the vaporizer and which is delivered to the third-stage preheater. Curve 198 represents the geothermal liquid which can be used for pre-heating FIG. 7 illustrates another embodiment of the invention wherein power plant system 210 produces power by means of two organic fluid turbines 252 and 254 wherein turbine 252 is a high pressure turbine and turbine 254 is a low pressure turbine. Vaporized working fluid is delivered to high pressure turbine 252 via line 277. The exhaust from high pressure turbine 252 is discharged through line 257, and then branches to lines 261 and 262. The turbine exhaust flowing through line 261 is delivered to low pressure turbine 254, and the turbine exhaust flowing through line 262 is delivered to heater 242. The remaining heat transfer means are identical to power plant system 110 and therefore for brevity need not be described. Also in this embodiment, under some circumstances, the first-stage preheater which receives working fluid liquid from the recuperator might not be used so that this preheater can be considered optional.

Figure 7A:
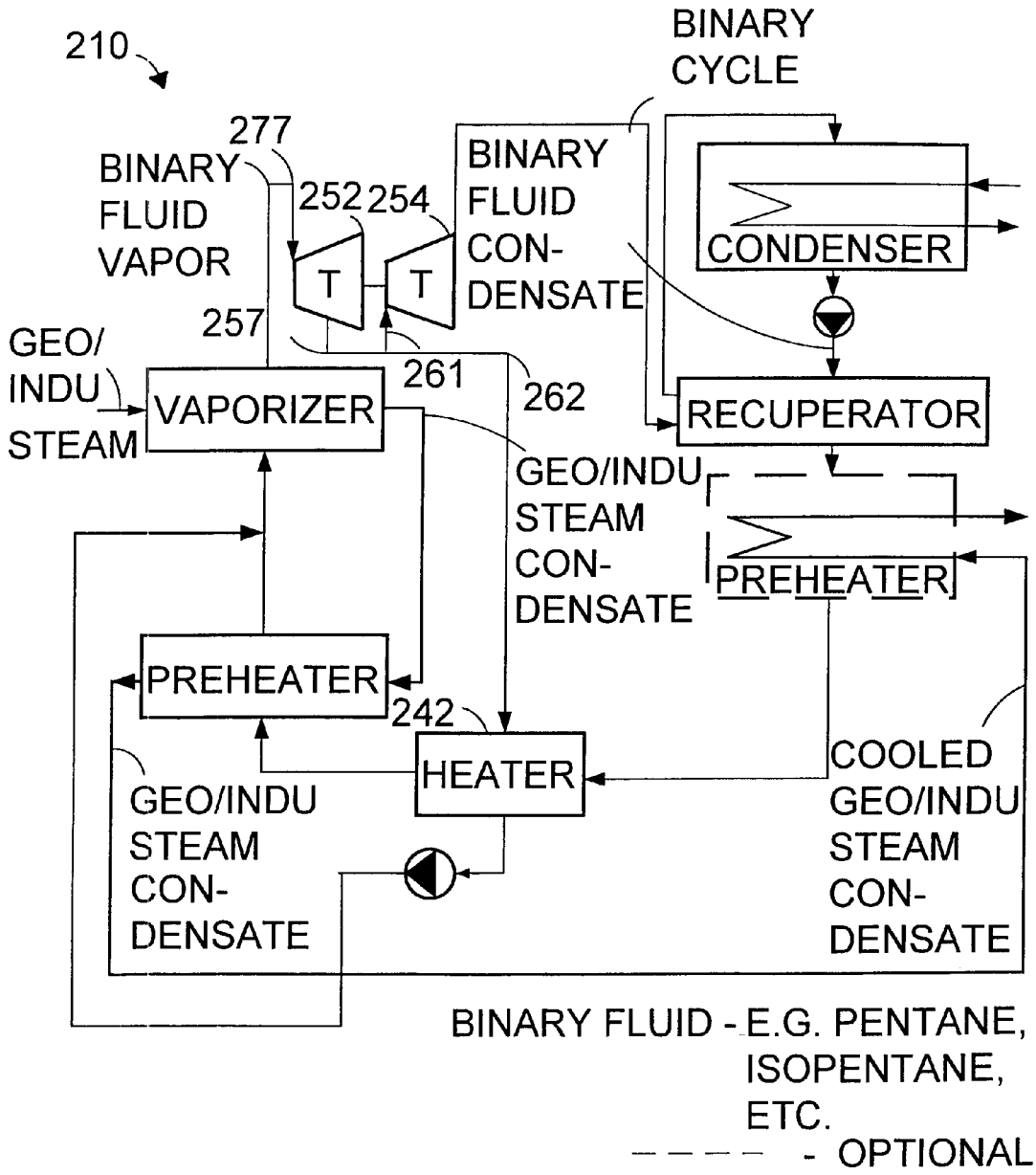
FIG. 7A is a block diagram of a geothermal-based power plant system provided with two organic turbines, according to according to another optional arrangement of the embodiment of the invention shown in and described with reference to FIG. 7.
Figure 7B:
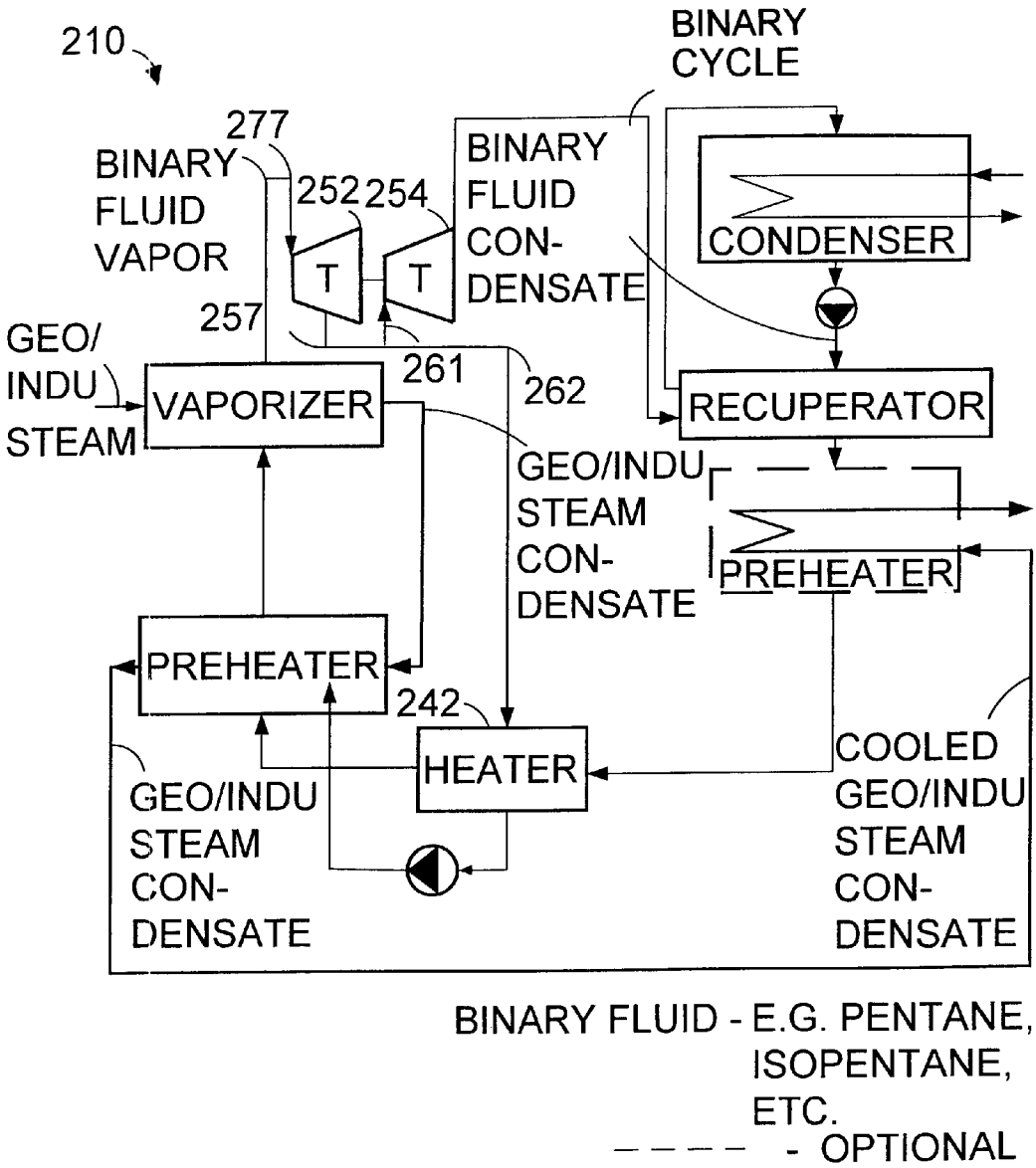
FIG. 7B is a block diagram of a geothermal-based power plant system provided with two organic turbines, according to according to another optional arrangement of the embodiment of the invention shown in and described with reference to FIG. 7.
Figure 7C:
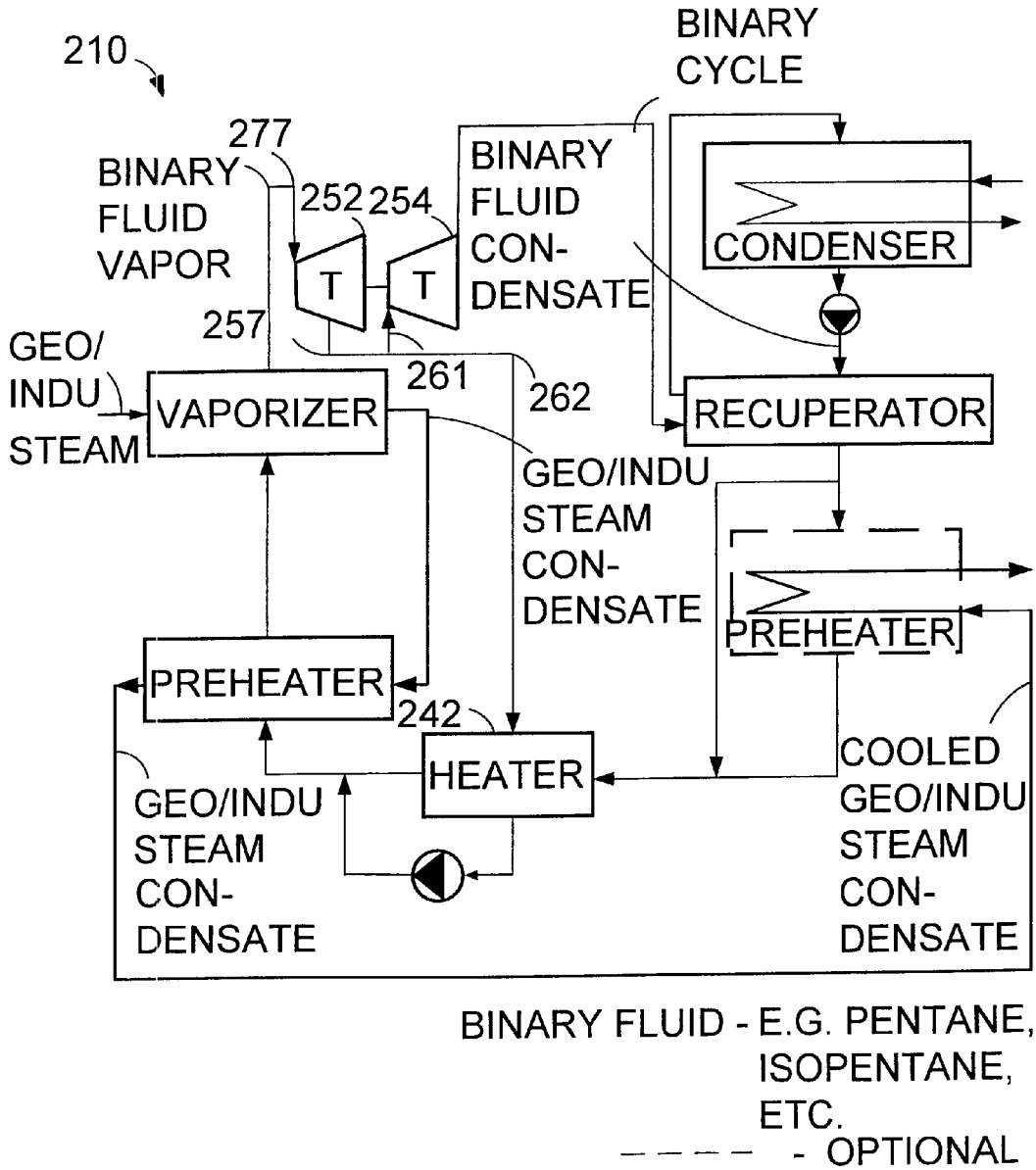
FIG. 7C is a block diagram of a geothermal-based power plant system provided with two organic turbines, according to according to another optional arrangement of the embodiment of the invention shown in and described with reference to FIG. 7.

Furthermore, the output of the pump extracting heated working fluid heated by heater 242 can be supplied to different locations in the working fluid cycle of the binary cycle power plant (see FIG. 7, 7A and 7B) in different optional configurations. In the option shown in FIG. 7, the output of the pump is supplied to the output of heater 242. In the option shown in FIG. 7A the output of the pump is supplied to the output of third-stage preheater and supplied to the vaporizer. In the option shown in FIG. 7B, the output of the pump is supplied to a suitable location in the third-stage preheater. In addition, in a further option, portion of the working liquid exiting the recuperator can be supplied to the first-stage preheater while a further portion can be supplied to the working fluid exiting the first-stage preheater and that is supplied to heater 242 (see FIG. 7C).

FIGS. 8-12 illustrate another embodiment of the invention wherein the energy source for producing power with improved heat utilization is supplied by an industrial heat source such as industrial steam. Similar to the other embodiments of the invention, working fluid is vaporized by the steam to generate electricity and working fluid exiting the recuperator is preheated by turbine exhaust.

Figure 8:
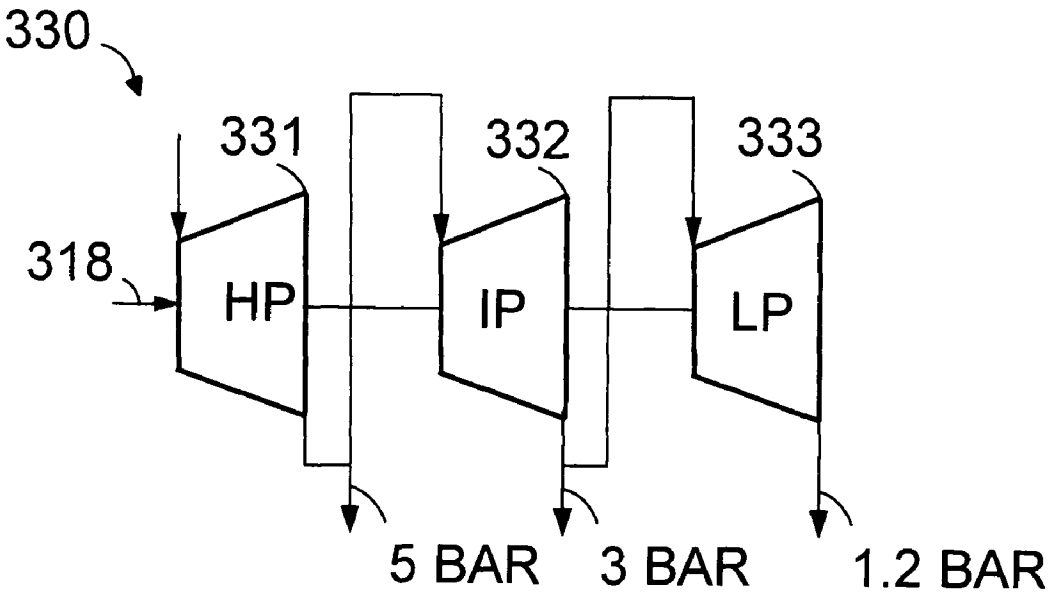
FIG. 8 is a schematic drawing of a multi-stage steam turbines.

As shown in FIG. 8, industrial steam flowing through line 318 is utilized to generate electricity by means of multi-stage steam turbine 880 having high pressure (HP) stage 831, intermediate pressure (IP) stage 382, and low pressure (LP) stage 833. For example, the industrial steam delivered to the inlet of multi-stage turbine 330 at a pressure of about 12 bar, is expanded in HP 831 to a pressure of about 5 bar, further expanded in IP 332 to about 3 bar, and additionally expanded in LP 388 to about 1.2 bar. Steam is bled off from each of these stages fi preheating the working fluid.

Figure 9:
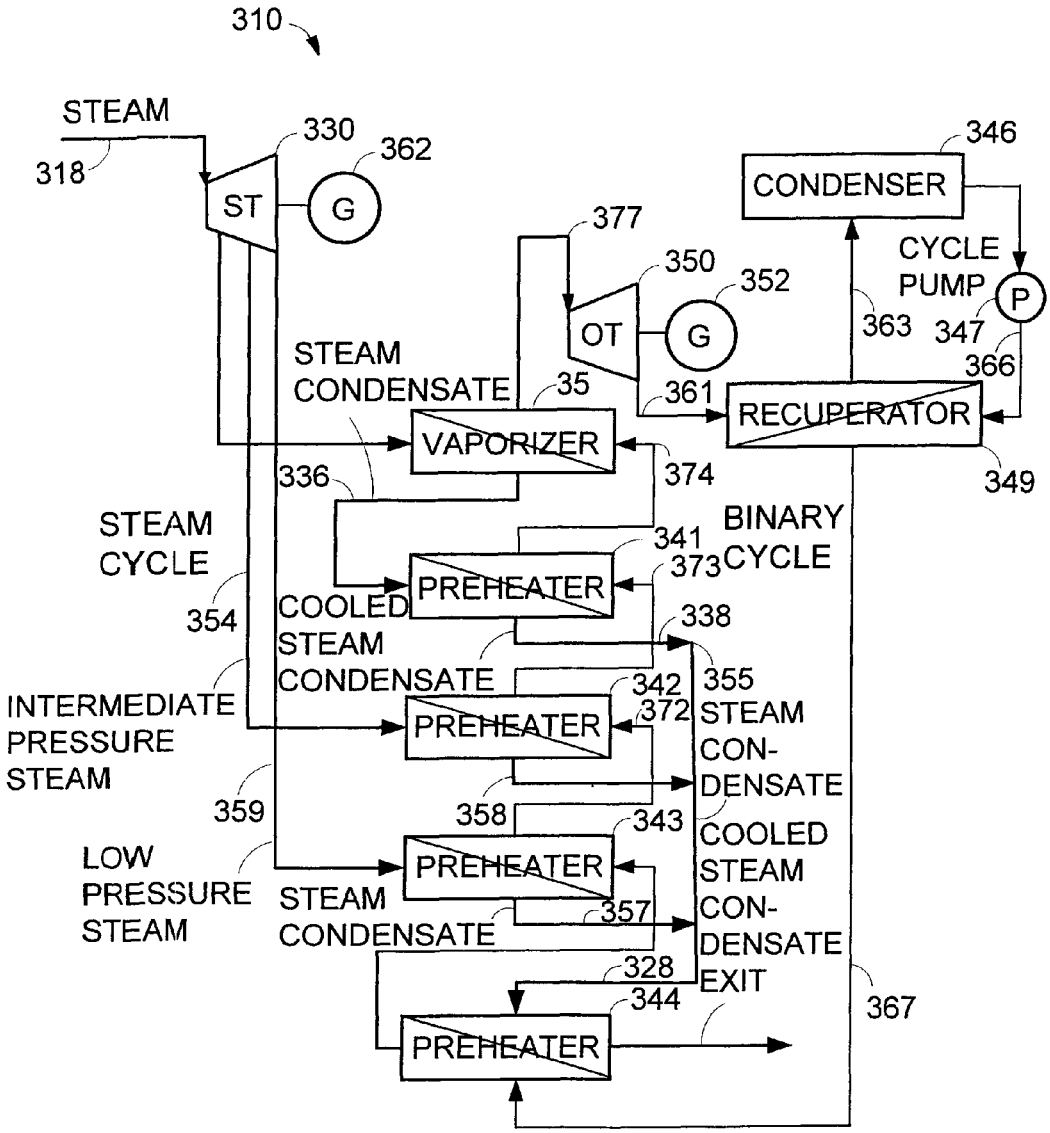
FIG. 9 is a block diagram of a power plant system powered by industrial steam which is provided with steam and organic turbines, according to another embodiment of the present invention.

FIG. 9 illustrates a power plant generally designated by reference numeral 810 that produces power by means of a multi-stage steam turbine (ST) and an organic fluid turbine (OT) wherein the energy source is industrial steam. The power plant system comprises an open steam cycle (represented by thick fluid lines), wherein industrial steam is delivered through line 318 to ST 380 and cooled steam condensate is discharged through line 385 and a closed binary cycle (represented by thin fluid lines), wherein binary working fluid extracts heat from the industrial steam to produce power in the OT.

Power plant system 310 comprises multi-stage steam turbine 330, electric generator 362 coupled to ST 380, vaporizer 385, cascading preheaters 341-344, condenser 346, pump 347, recuperator 349, organic fluid turbine 350, and electric generator 352 coupled to OT 350.

Industrial steam delivered in line 318 to ST 330 expands therein to produce power, and is bled from each stage of ST 330 to transfer heat to the working fluid so that the latter will produce power in OT 350. Steam bled from the HP stage of ST 380 is delivered via line 339 to vaporizer 335 and used to vaporize preheated working fluid. The resulting steam condensate is delivered via line 386 to fourth-stage preheater 341, and after its heat is transferred to the working fluid by means of preheater 341, the discharged cooled steam condensate flows via line 338 to common conduit 355. Steam bled from the IP state of ST 30 is delivered via line 354 to third-stage preheater 342 and after its heat is transferred to the working fluid by means of preheater 342, the discharged steam condensate flows therefrom via line 368 to common conduit 355. Steam bled from the LP stage of ST 380 is delivered via line 359 to second-stage preheater 343 and after its heat is transferred to the working fluid by means of preheater 343, is discharged therefrom as steam condensate, which is delivered via line 357 to common conduit 355. Fluid discharged from preheaters 341-848 is mixed within common conduit 355 and is delivered to first-stage preheater 344 via line 328. After its heat is transferred to the working fluid by means of the preheater, the cooled steam condensate discharged from first-stage preheater 344 exits via line 385.

OT 350 exhausts expanded organic vapor, after work has been performed, via line 361 to recuperator 349. The heat depleted expanded organic vapor exits recuperator 349 via line 368 and is delivered to condenser 346, which condenses the vapor by means of a cooling fluid (not shown). Working fluid condensate is circulated by pump 347 through line 366 to recuperator 349, where heat is transferred from the expanded organic vapor to the working fluid condensate, and then through line 367 to first-stage preheater 344, from which the preheated working fluid condensate is delivered via line 371 to second-stage preheater 348. Additional heat is transferred to the preheated working fluid condensate by means of second-stage preheater 343, third-stage preheater 342, and fourth stage preheater 341 while the preheated working fluid condensate is discharged from these preheaters via lines 372-374, respectively. Discharged preheated working fluid condensate is supplied via line 374 to vaporizer 385 and vaporized working fluid produced therein is delivered to OT 850 via line 877.

Figure 10:
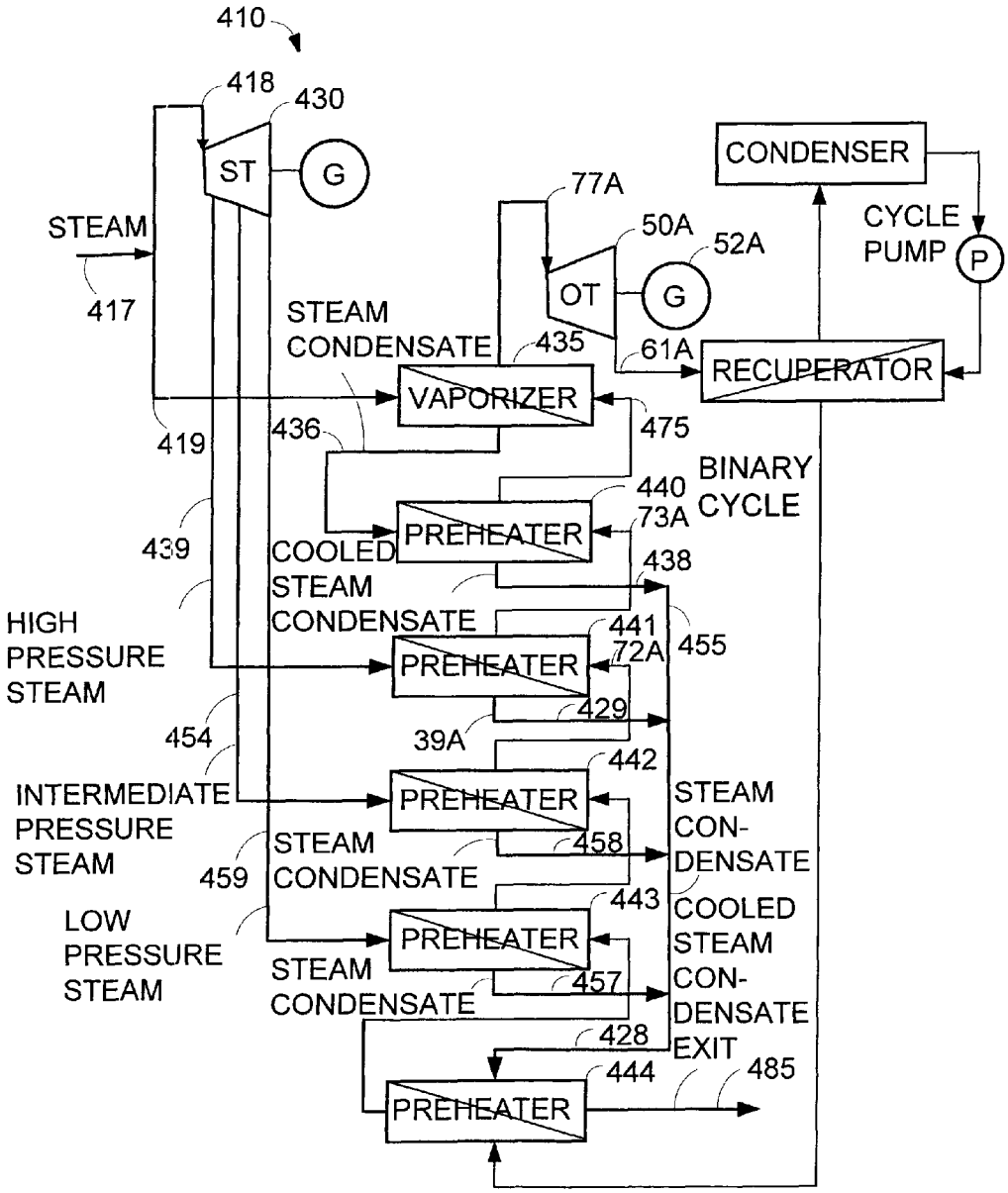
FIG. 10 is a block diagram of a power plant system powered by industrial steam which is provided with steam and organic turbines, according to a further embodiment of the present invention.

FIG. 10 illustrates another embodiment of the invention wherein power plant system 410 having an industrial steam energy source comprises five cascading preheaters 440-444 for transferring heat from the steam bled from multi-stage steam turbine 430 to the working fluid. The industrial steam delivered through line 417 branches into lines 418 and 419, which extend to ST 430 and vaporizer 435, respectively. Steam condensate resulting from the vaporization of the preheated working fluid, which is delivered from fifth-stage preheater 440 to vaporizer 435 via line 475, is delivered via line 486 to fifth stage preheater 440, and after its heat is transferred to the working fluid by means of preheater 440, the discharged cooled steam condensate flows via line 488 to common conduit 455. Steam bled from the HP stage of ST 480 is delivered via line 439 to fourth-stage preheater 441 and after its heat is transferred to the working fluid by means of preheater 441, the steam condensate is discharged therefrom via line 429 to common conduit 455. Steam bled from the IP stage of ST 480 is delivered via line 454 to third-stage preheater 442 and after its heat is transferred to the working fluid by means of preheater 442, the steam condensate is discharged therefrom via line 458 to common conduit 455. Steam bled from the LP stage of ST 480 is delivered via line 459 to second-stage preheater 448 and, after its heat is transferred to the working fluid by means of preheater 443, is discharged therefrom as steam condensate, which is delivered via line 457 to common conduit 455. Fluid discharged from preheaters 440-448 is mixed in common conduit 455 and is delivered to first-stags preheater 444 via line 428. The cooled steam condensate discharged from first-stage preheater 444 exit via line 485. The remaining heat transfer means are identical to power plant system 310 and therefore for brevity need not be described.

While the embodiments shown and described with reference to FIGS. 9 and 10 show three different outlets of steam turbine 380 or 480 for use of high, intermediate and low pressure steam in preheating the organic working fluid, usually two different outlets will suffice.

Figure 4A:
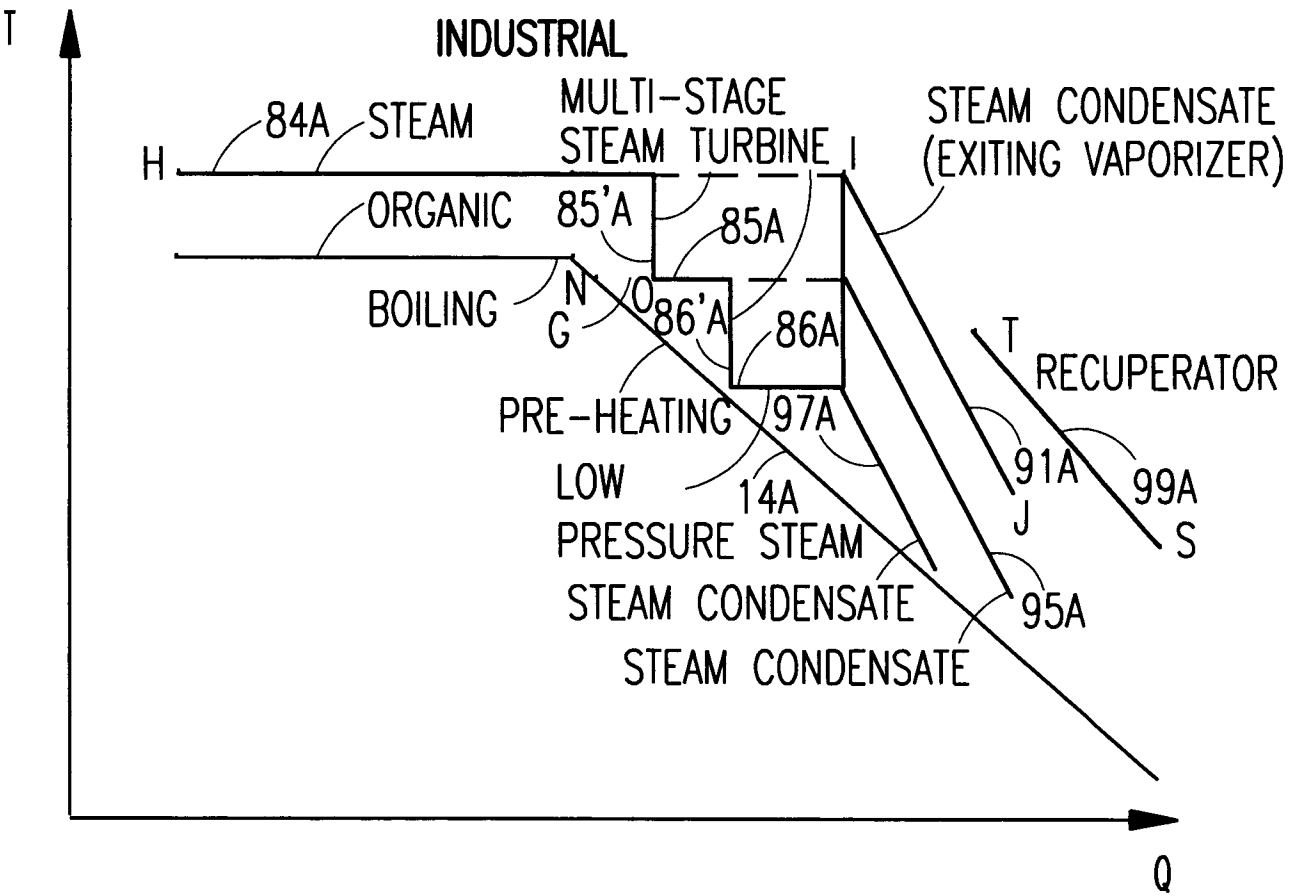
FIG. 4A is also a temperature/heat diagram for another power plant system shown in FIG. 10.

Furthermore, the relevant temperature/heat diagram or the industrial embodiment shown and described with reference to FIG. 10 operating at two different pressure levels is actually FIG. 4A. In such an industrial application, since no geothermal liquid is present, industrial steam condensate provides preheating of the organic working fluid as shown by curves 91A 95A and 97A. The remaining heat transfer processes are identical to geothermal power plant system 10A, shown in FIG. 3A, and therefore or brevity need not be described.

Figure 6A:
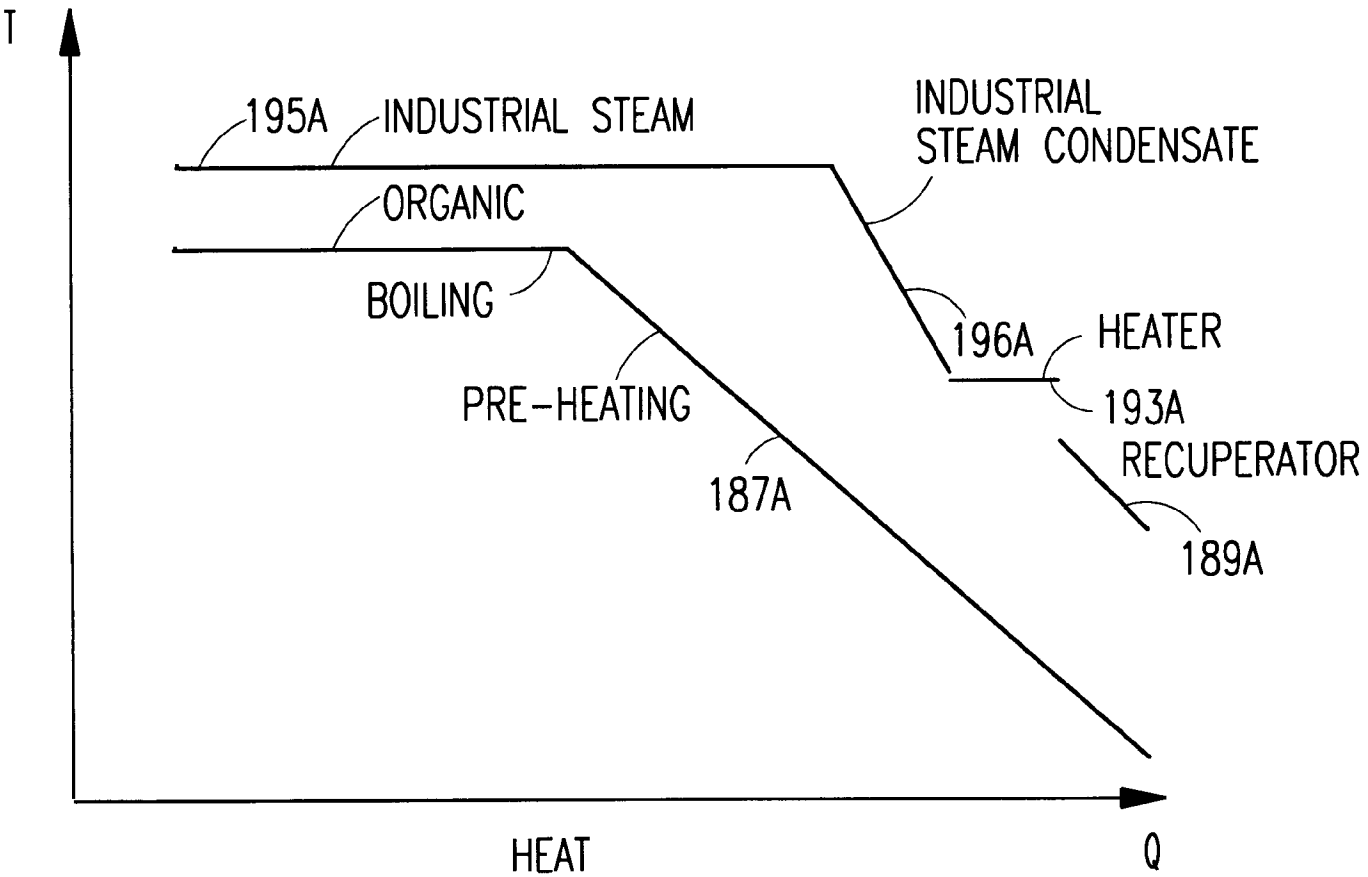
FIG. 6A is also a temperature/heat diagram for another power plant system shown in FIG. 6.

It is to be pointed that while reference is made to FIGS. 8-12 for describing an embodiment of the invention wherein the energy source for producing power with improved heat utilization is supplied by an industrial heat source such as industrial steam, such an industrial energy source can also be used in connection with the embodiments of the invention described with reference to FIGS. 5 and 7. In such a case, FIG. 6A presents the relevant temperature/heat diagram for such an industrial application of the power plant. In such an industrial application, since no geothermal liquid is present, industrial steam condensate provides preheating of the organic working fluid as shown by curve 196A. The remaining heat transfer processes are identical to geothermal power plant system 110 and therefore for brevity need not be described.

Furthermore, while pentane and iso-pentane are disclosed as the preferred working fluids other fluids can be used as working fluids such as butane and iso-butane, etc.

While some embodiments of the invention have been described by way of illustration, it will be apparent that the invention can be cried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. A power plant system for producing power using a source of steam, comprising:

a) a vaporizer into which steam from a source of steam is supplied, for vaporizing organic working fluid flowing through said vaporizer;

b) at least one organic vapor turbine to which said vaporized working fluid is supplied and which is suitable for generating electricity and producing expanded organic vapor;

c) a recuperator for heating organic vapor condensate flowing towards said vaporizer using said expanded organic vapor exhausted from said organic vapor turbine; and d) two or more stages of preheaters for additionally heating organic working fluid exiting said recuperator and flowing towards said vaporizer, wherein a portion of the organic working fluid exiting said recuperator bypasses one of said stages of preheaters and is supplied, together with working fluid exiting said one of said stages, to a further stage of preheaters.

2. A power plant system for producing power using a source of steam, comprising:

a) a vaporizer into which steam from a source of steam is supplied, for vaporizing organic working fluid flowing through said vaporizer;

b) at least one organic vapor turbine to which said vaporized working fluid is supplied and which is suitable for generating electricity and producing expanded organic vapor;

c) a recuperator for heating organic vapor condensate flowing towards said vaporizer using said expanded organic vapor exhausted from said organic vapor turbine; and d) two or more stages of preheaters for additionally heating organic working fluid exiting said recuperator and flowing towards said vaporizer, wherein fluid extracted from said at least one organic vapor turbine is delivered to one of said stages of preheaters, wherein heat-depleted extracted fluid exiting said one of said stages of preheaters is supplied to a further stage preheater at a suitable location in the further stage preheater.

3. The power plant system according to claim 1, wherein source of steam is geothermal steam.

4. The power plant system according to claim 1, wherein source of steam is industrially generated steam.

5. The power plant system according to claim 1, wherein said power plant further comprises a condenser for producing organic working fluid condensate.

6. The power plant system according to claim 1, wherein three stages of preheating means are employed.

7. The power plant system according to claim 1, further comprising extraction means for extracting fluid from said organic vapor turbine and delivering the extracted fluid to one of said stages of preheaters.

8. The power plant system according to claim 1, wherein said organic vapor turbine is a high pressure organic fluid turbine, whereby a portion of the vapor exhausted from said high pressure organic fluid turbine is delivered to a low pressure organic fluid turbine and a further portion of the vapor exhausted from said high pressure organic fluid turbine is delivered to one of said stages of preheaters.

9. The power plant system according to claim 8, wherein said one of said stages of preheaters to which said further portion of the vapor exhausted from said high pressure organic fluid turbine is delivered is a heater, whereby organic fluid passing therethrough is heated.

10. The power plant system according to claim 7, wherein the preheater stage to which fluid extracted from the organic vapor turbine is supplied is a heater, whereby organic fluid passing therethrough is heated.

* * * * *